US005199265A

United States Patent [19]

Borkowicz

[11] Patent Number: 5,199,265

[45] Date of Patent: Apr. 6, 1993

[54] TWO STAGE (PREMIXED/DIFFUSION) GAS ONLY SECONDARY FUEL NOZZLE

[75] Inventor: Richard J. Borkowicz, Ballston Spa, N.Y.

[73] Assignee: General Electric Company, Schenectady, N.Y.

[21] Appl. No.: 680,073

[22] Filed: Apr. 3, 1991

[51] Int. Cl.[5] ..... F23R 3/34

[52] U.S. Cl. ..... 60/737; 60/746

[58] Field of Search ..... 60/722, 732, 733, 734, 60/737, 738, 746, 747, 748, 749

[56] References Cited

U.S. PATENT DOCUMENTS

| | | | |
|---|---|---|---|
| 2,955,420 | 10/1960 | Schirmer . | |
| 2,999,359 | 9/1961 | Murray . | |
| 3,048,014 | 8/1962 | Schmidt . | |
| 3,946,553 | 3/1976 | Roberts et al. . | |
| 3,958,416 | 5/1976 | Hammond, Jr. et al. . | |
| 3,973,395 | 8/1976 | Markowski et al. . | |
| 4,112,676 | 9/1978 | DeCorso . | |
| 4,173,118 | 11/1979 | Kawaguchi . | |
| 4,193,260 | 3/1980 | Carlisle et al. . | |
| 4,262,482 | 4/1981 | Roffe et al. . | |
| 4,292,801 | 10/1981 | Wilkes et al. | 60/733 |
| 4,389,848 | 6/1983 | Markowski et al. | 60/738 |
| 4,420,929 | 12/1983 | Jorgensen et al. . | |
| 4,498,288 | 2/1985 | Vogt . | |
| 4,589,260 | 5/1986 | Krockow | 60/737 |
| 4,603,548 | 8/1986 | Ishibashi et al. | 60/39.06 |
| 4,683,715 | 8/1987 | Iizuka et al. . | |
| 4,698,963 | 10/1987 | Taylor . | |
| 4,716,719 | 1/1988 | Takahashi et al. . | |
| 4,787,208 | 11/1988 | DeCorso . | |
| 4,805,411 | 2/1989 | Hellat et al. . | |
| 4,944,149 | 7/1990 | Kuwata . | |
| 4,949,538 | 8/1990 | Iasillo et al. . | |
| 4,967,561 | 11/1990 | Bruhwiler et al. | 60/746 |
| 4,974,415 | 12/1990 | Shekleton et al. | 60/733 |
| 4,982,570 | 1/1991 | Waslo et al. | 60/733 |
| 4,984,429 | 1/1991 | Waslo et al. | 60/752 |
| 5,030,871 | 7/1991 | Shah et al. . | |
| 5,054,280 | 10/1991 | Ishibashi et al. | 60/39.06 |
| 5,081,843 | 1/1992 | Ishibashi et al. | 60/733 |

OTHER PUBLICATIONS

"Gas Turbine Combustion and Emissions", Gas Turbine Reference Library, Dr. L. B. Davis, Jr., GE Company (no date).

"General Electric Gas Turbine Multiple-Combustion System", Gas Turbine Reference Library, Edward J. Walsh, GE Company, 1984.

"Dry Low NOx Combustion System for Utility Gas Turbine", AMSE, R. M. Washam, GE Company, 1983.

"Development of a Dry Low NOx Combustor", AMSE, Davis & Washam, GE Company, Jun. 1989.

*Primary Examiner*—Richard A. Bertsch
*Assistant Examiner*—Timothy S. Thorpe
*Attorney, Agent, or Firm*—Nixon & Vanderhye

[57] ABSTRACT

A secondary nozzle for a gas turbine includes an elongated, tubular nozzle body having an inlet end and an outlet end; a tubular core assembly having an outer diameter less than an interior diameter of the tubular nozzle body to thereby define a diffusion fuel passage between the core assembly and the tubular nozzle body extending to the outlet end, and a premix fuel passage through the core assembly extending to a pilot orifice at the outlet end; an air passage located along at least a portion of the tubular nozzle body and located radially between the diffusion and premix fuel passages; and, a plurality of gas injectors extending radially out of the elongated tubular nozzle body from the premix fuel passage.

13 Claims, 3 Drawing Sheets

TWO STAGE (PREMIXED/DIFFUSION) GAS ONLY SECONDARY FUEL NOZZLE

BACKGROUND AND SUMMARY OF THE INVENTION

This invention relates to gas turbine combustors; and, in particular, to improvements in gas turbine combustors for the further reduction of air pollutants such as nitrogen oxides (NOx).

In an effort to reduce the amount of NOx in the exhaust gas of a gas turbine, inventors Wilkes and Hilt devised the dual stage, dual mode combustor which is disclosed in U.S. Pat. No. 4,292,801 issued Oct. 6, 1981 to a common assignee of the present invention, and incorporated herein by reference. In this patent, it is disclosed that the amount of exhaust NOx can be greatly reduced, as compared with a conventional single stage, single fuel nozzle combustor, if two combustion chambers are provided. The specific configuration as described in the above identified patent includes an annular array of primary nozzles each of which discharges fuel into the primary combustion chamber, and a central secondary nozzle which discharges fuel into the secondary combustion chamber. The secondary nozzle has an axial fuel delivery pipe surrounded at its discharge end by an air swirler which provides combustion air to the fuel nozzle discharge.

The combustor is operated by first introducing fuel and air into the first chamber for burning therein. Thereafter, the flow of fuel is shifted into the second chamber until burning in the first chamber terminates, followed by a reshifting of fuel distribution into the first chamber for mixing purposes, with burning occurring only in the second chamber. The combustion in the second chamber is rapidly quenched by the introduction of substantial amounts of dilution air into the downstream end of the second chamber to reduce the residence time of the products of combustion at NOx producing temperatures thereby providing a motive force for the turbine section which is characterized by low amounts of NOx, carbon monoxide and unburned hydrocarbon emissions.

Further development in this area produced a two stage (diffusion/premixing) secondary fuel nozzle as described in commonly assigned, application Ser. No. 07/501,439 filed Nov. 25, 1986, now U.S. Pat. No. 4,982,570 the disclosure of which is also expressly incorporated by reference herein. As described in the above identified co-pending application, it was discovered that further reduction in the production of NOx could be achieved by altering the design of the central or secondary nozzle such that it may be described as a diffusion piloted premixed nozzle. In operation, a relatively small amount of fuel is used to sustain a diffusion pilot, while a premix section of the nozzle provides additional fuel for ignition of the main fuel supply from the upstream primary nozzles.

The primary object of this invention is to improve transfer to premixed mode of operation via a diffusion flame, and once in the premixed operation mode, to turn off the diffusion flame and start the premixing flame so as to enable the gas turbine to operate at its design point for any desired length of time. Transferring to a premixed mode with a diffusion flame in accordance with this invention has the characteristic of low combustion dynamic pressure activity.

In accordance with an exemplary embodiment of the invention, a two stage (diffusion/premixing), gas only secondary fuel nozzle is provided which has two fuel circuits. This allows the nozzle to operate in a premixed mode or diffusion mode. The secondary nozzle of each combustor is located within a centerbody and extends through a liner provided with a swirler through which combustion air is introduced for mixing with fuel from the secondary nozzle. The secondary nozzle is arranged to discharge fuel into a throat region between an upstream primary combustion chamber and a downstream secondary combustion chamber. In this preferred embodiment, fuel is supplied to the secondary nozzle through concentrically arranged diffusion and premix pipes.

The premix fuel supply pipe is connected to a centrally located premix fuel passage which extends axially along a center portion of the nozzle. It will be appreciated, of course, that: the fuel is not premixed with air prior to injection. Reference to the premix fuel supply pipe and/or premix fuel passage is merely intended to aid in understanding the invention and to maintain a convenient distinction between the fuel for the premixed mode of operation and the fuel for the diffusion mode of operation. The premix fuel passage includes an enlarged diameter portion and an interconnected smaller diameter pilot portion. A small portion of premix fuel is discharged through a single pilot orifice located at a forward end of the nozzle.

The secondary fuel nozzle also includes a plurality of radially outwardly extending gas injectors, each of which contains a number of fuel discharge orifices, the pipes extending radially outwardly from the premix passage, beyond the body portion of the secondary nozzle for discharging fuel into an area between the nozzle and the liner to mix with combustion air within the liner for discharge into the secondary combustion chamber.

The secondary nozzle is also provided with a series of radial air inlets which communicate with an air passage surrounding a portion of the premix fuel passage for discharging combustion air via a swirler located adjacent the premix fuel pilot orifice.

A diffusion fuel passage (reference to a diffusion fuel passage merely has reference to that portion of the fuel supply which will be used in the diffusion mode of operation) is provided within the secondary nozzle radially outwardly of both the premix fuel passage and the above described air passage for discharge through a plurality of orifices located in an annular array at the forward end of the secondary nozzle.

Thus, in accordance with an exemplary embodiment of the invention, there is provided a secondary nozzle for a gas turbine which includes primary and secondary combustion zones, the secondary nozzle comprising an elongated, tubular nozzle body having an inlet end and an outlet end; a tubular core assembly having an outer diameter less than an interior diameter of the tubular nozzle body to thereby define a first axial fuel passage between the core assembly and the tubular nozzle body extending to at least one discharge orifice at the outlet end, and a second axial fuel passage through the core assembly extending to a pilot orifice at the outlet end; an air passage located along at least a portion of the tubular nozzle body and located radially between the first and second fuel passages; and, a plurality of gas injectors extending radially out of the elongated tubular nozzle body from the second fuel passage, upstream of said outlet end.

Other objects and advantages of the subject invention will become apparent from the detailed description which follows.

DETAILED DESCRIPTION OF THE DRAWINGS

Figure 1:
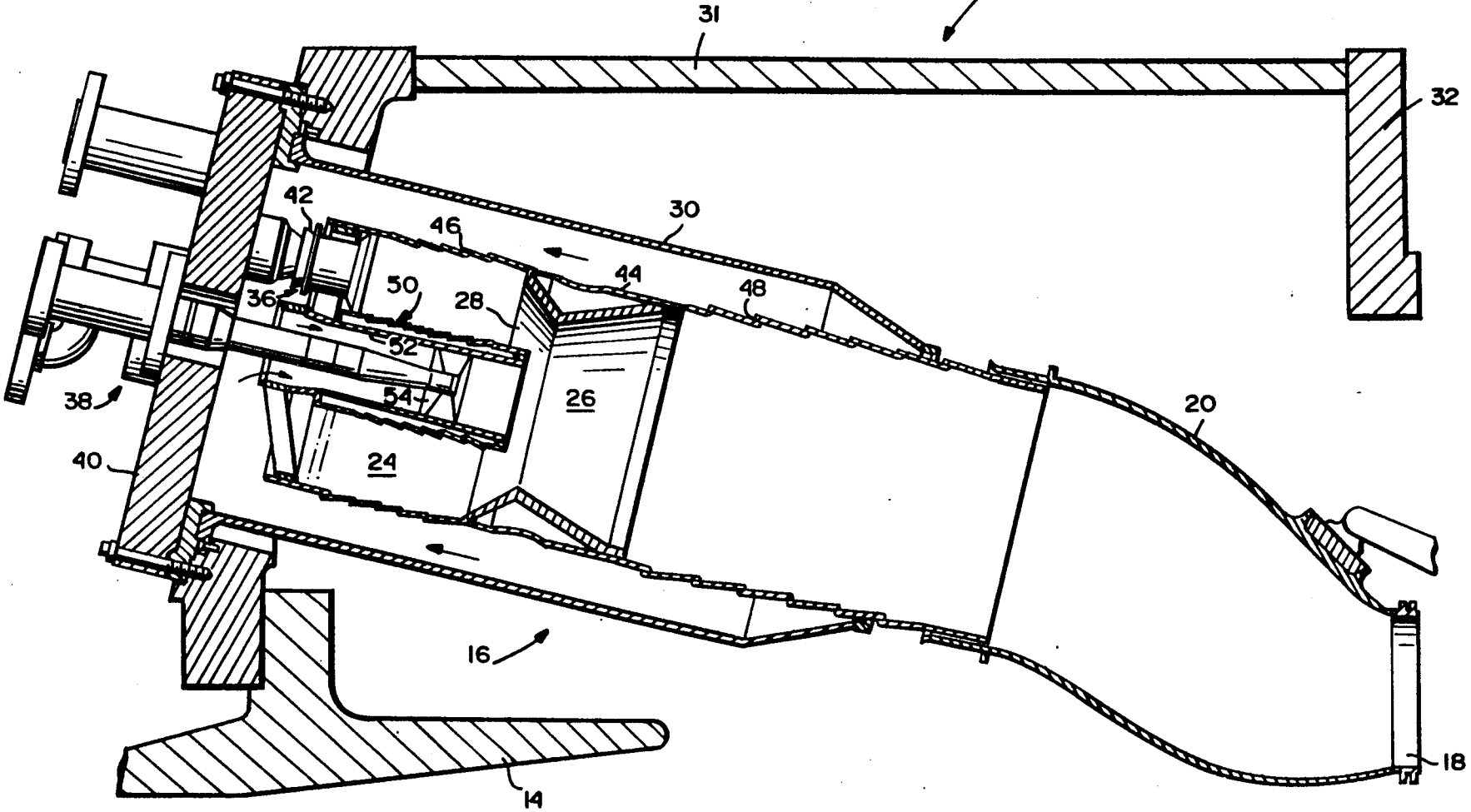
FIG. 1 is a partial cross sectional view of a known dry low NOx combustor.

Referring to FIG. 1, a gas turbine 12 of the type disclosed in U.S. Pat. No. 4,292,801 includes a compressor 14, a combustor 16 and a turbine represented for the sake of simplicity by a single blade 18. Although it is not specifically shown, it is well known that the turbine is drivingly connected to a compressor along a common axis. The compressor 14 pressurizes inlet air which is then turned in direction or reverse flowed to the combustor 16 where it is used to cool the combustor and also used to provide air to the combustion process. The gas turbine includes a plurality of the generally cylindrical combustors 16 (only one shown) which are located about the periphery of the gas turbine. In one particular gas turbine model, there are fourteen such combustors. A transition duct 20 connects the outlet end of its particular combustor with the inlet end of the turbine to deliver the hot products of the combustion process to the turbine.

Each combustor 16 comprises a primary or upstream combustion chamber 24 and a secondary or downstream combustion chamber 26 separated by a venturi throat region 28. The combustor 16 is surrounded by a combustor flow sleeve 30 which channels compressor discharge air flow to the combustor. The combustor is further surrounded by an outer casing 31 which is bolted to the turbine casing 32.

Primary nozzles 36 provide fuel delivery to the upstream combustion chamber 24 and are arranged in an annular array around a central secondary nozzle 38. In one model gas turbine, each combustor may include six primary nozzles and one secondary nozzle. Each of the primary nozzles 36 protrudes into the primary combustion chamber 24 through a rear wall 40. Secondary nozzle 38 extends from the rear wall 40 to the throat region 28 in order to introduce fuel into the secondary combustion chamber 26. Fuel is delivered to the nozzles 36 through fuel lines (not shown) in a manner well known in the art and described in the aforementioned '801 patent. Ignition in the primary combustion chamber is caused by a spark plug and associated cross fire tubes, also well known in the art, and omitted from the present drawings for the sake of clarity.

Combustion air is introduced into the fuel stage through air swirlers 42 positioned adjacent the outlet ends of nozzles 36. The swirlers 42 introduce swirling combustion air which mixes with the fuel from nozzles 36 and provides an ignitable mixture for combustion, on start-up, in chamber 24. Combustion air for the swirlers 42 is derived from the compressor 14 and the routing of air between the combustion flow sleeve 30 and the wall 44 of the combustor chamber.

The cylindrical wall 44 of the combustor is provided with slots or louvers 46 in the primary combustion chamber 24, and similar slots or louvers 48 downstream of the secondary combustion chamber 26 for cooling purposes, and for introducing dilution air into the combustion zones to prevent substantial rises in flame temperature.

The secondary nozzle 38 is located within a centerbody 50 and extends through a liner 52 provided with a swirler 54 through which combustion air is introduced for mixing with fuel from the secondary nozzle as described in greater detail below.

To this point, the apparatus is substantially as shown in the above identified '801 patent.

Figure 2:
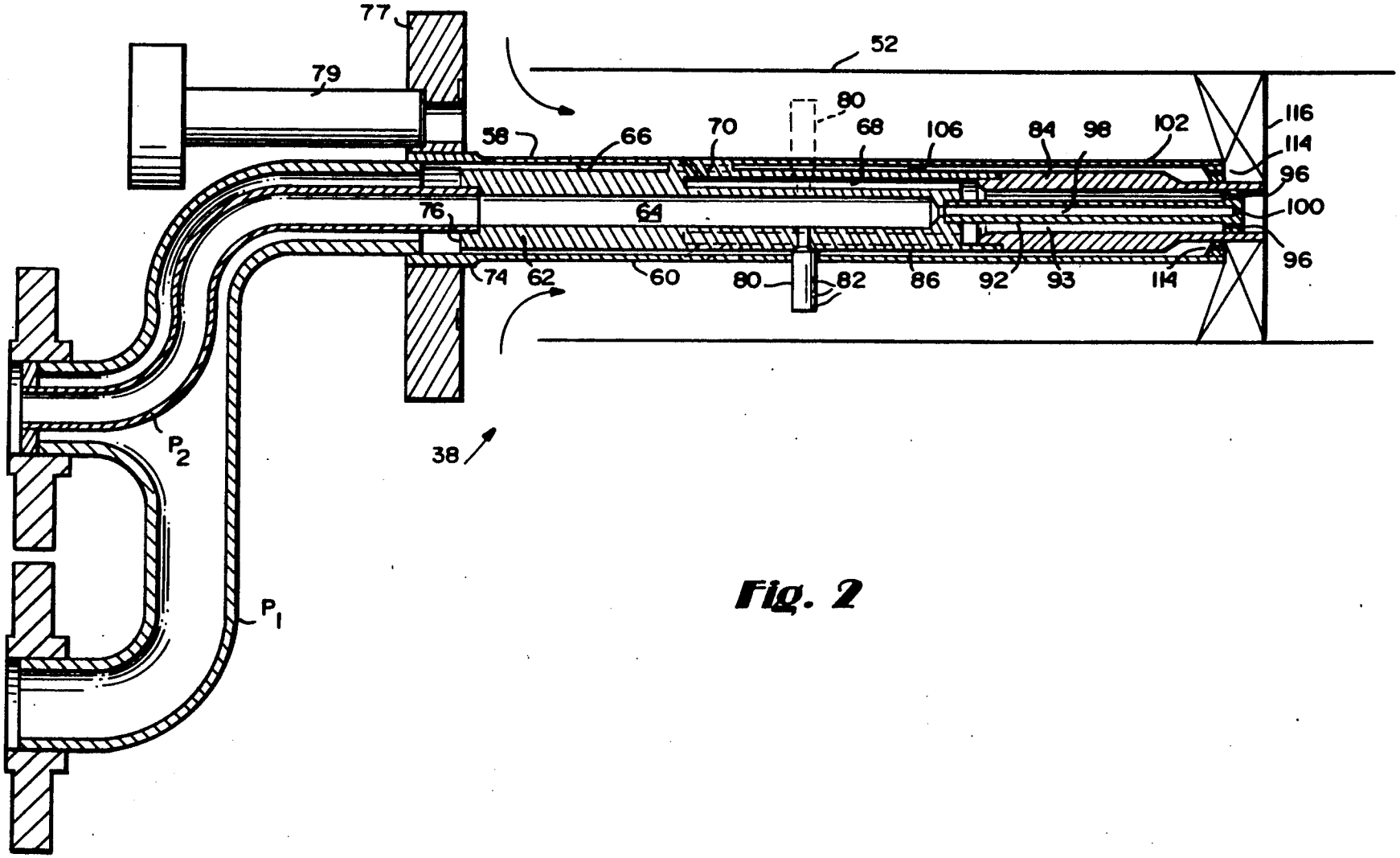
FIG. 2 is a partial cross sectional view of a secondary premixed/diffusion fuel nozzle in accordance with an exemplary embodiment of the invention, for use in the combustor shown in FIG. 1.
Figure 3:
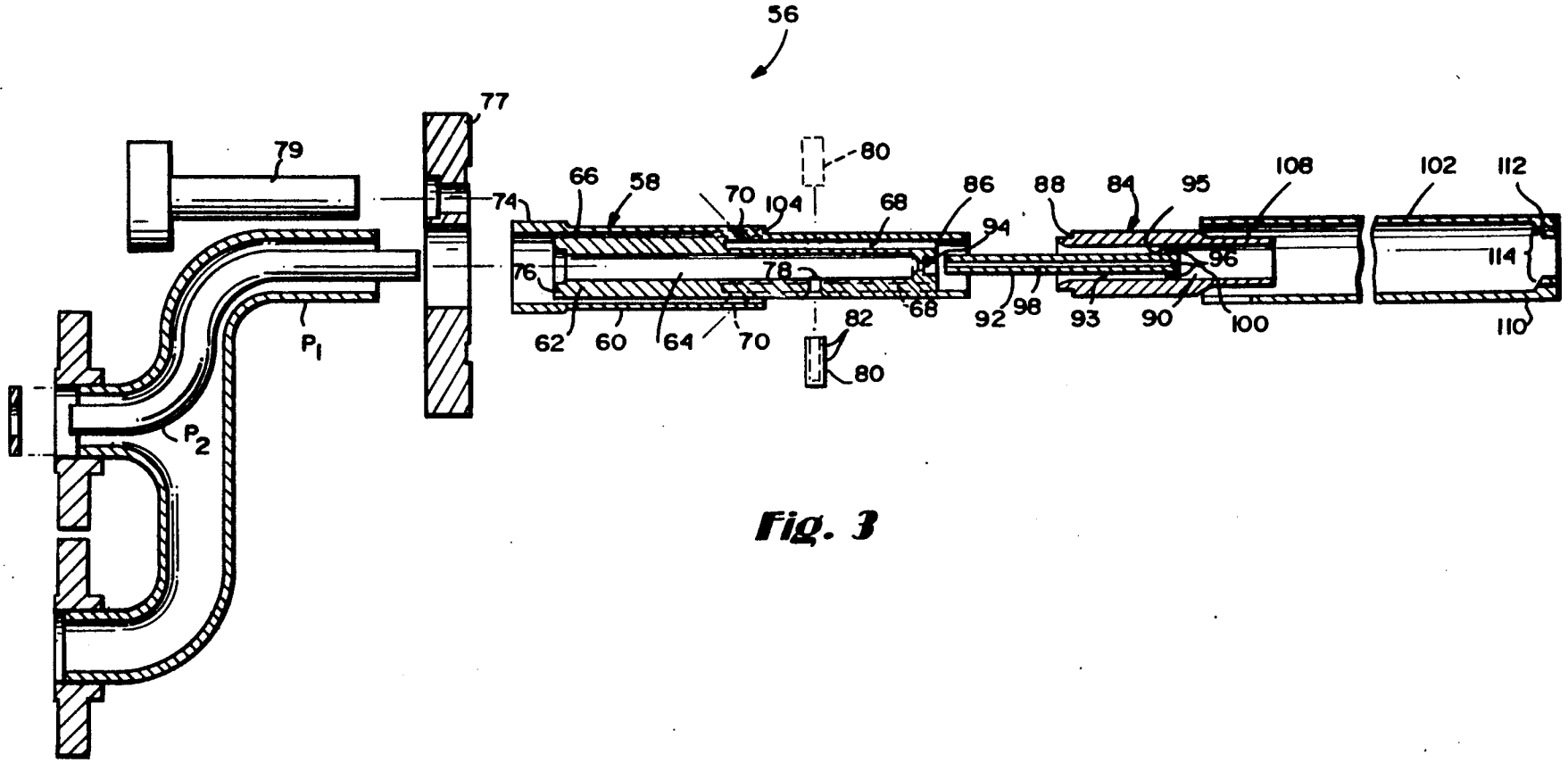
FIG. 3 is an exploded cross sectional view of the secondary nozzle illustrated in FIG. 2.

Referring now to FIGS. 2 and 3, a two stage (premixed/diffusion), gas only secondary fuel nozzle assembly 56 in accordance with an exemplary embodiment of the invention is illustrated. It will be appreciated that the secondary fuel nozzle assembly 56 is to be located within the centerbody 50 and liner 52 which, in turn, are located centrally of the primary or upstream combustion chamber 24 as shown in FIG. 1.

For this unique secondary nozzle construction, fuel is supplied to sustain a flame by diffusion pipe $P_1$ and to sustain a premixed flame by pipe $P_2$ which, at the inlet to the secondary fuel nozzle assembly 56, are arranged concentrically relative to each other.

The secondary nozzle assembly 56, as best seen in FIG. 3, includes a plurality of assembled elements. A rearward component, or gas body, 58 includes an outer sleeve portion 60 and an inner hollow core portion 62 provided with a central bore forming a premix fuel passage 64. The core portion 62 is located radially inwardly of the sleeve portion 60 to provide a diffusion fuel passage 66 therebetween, the sleeve portion 60 extending only to about the axial mid-point of the component 58. A plurality of axial air passages 68 are formed in a forward half of the rearward component 58 in surrounding relationship to the premix passage 64. A like number of radial wall portions (e.g., four) are arranged about the end of sleeve portion 60 and each includes an inclined, radial aperture 70 for permitting air within the liner 52 to enter a corresponding air passage 68.

The rearward end of component 58 includes an enlarged outer end 74 and an inner end 76 which are adapted to receive the fuel pipes $P_1$, $P_2$, respectively, as shown in FIG. 2, within a mounting flange 77, which also mounts a flame detector 79.

A plurality of radial holes 78 are provided about the circumference of the forward portion of component 58, permitting a like number of radial gas injector tubes 80 to be received therein to thereby establish communication with the premix passage 64. Each tube 80 is provided with a plurality of apertures or orifices 82 so that fuel from the premix passage 64 may be discharged into the area between the nozzle assembly 54 and liner 52 for mixing with combustion air within the liner. The gas injectors 80 are designed to evenly distribute fuel into the air flow, particularly because good mixing of fuel and air inside of the liner 52 is necessary to minimize NOx emissions.

A forward, interior component or air tip 84 of the nozzle assembly 54 has an outer diameter substantially equal to the reduced outer diameter of the forward portion 86 of the rearward component 58. The rearward end of component 84 is provided with an annular shoulder 88, permitting component 84 to axially abut the forward portion 86, so as to insure a smooth, continuous interface therebetween.

Component 84 is also provided with a central bore 90 which receives a smaller diameter pilot tube 92. The annular space 93 between the wall of bore 90 and the pilot tube 92 thus forms a single, annular continuation of the air passages 68. The rearward end of pilot tube 92 is received within a counter bore 94 provided in core component 62. The forward end of inlet tube 92 is formed with a radially enlarged wall 95 which slidably engages the interior wall of bore 90. Wall 95 is provided with a plurality of swirler slots 96 for discharging air from the air passages 68 in a manner described below. An interior bore 98 of pilot tube 92 provides a reduced diameter extension of the premix passage 64, and communicates with a pilot orifice 100 at a forward end thereof.

A forward outer sleeve or gas tip 102, which has an interior diameter greater than the outer diameter of component 84 and forward portion 86 of the rearward component 58, is adapted for abutment with a shoulder 104 formed by the termination of sleeve 60, thereby creating a radially outer space 106 (FIG. 2) which extends coaxially and continuously with air passage 68.

A reduced diameter forward end 108 of the interior component 84 extends beyond the forward end 110 of sleeve 102. The face 112 of part 102 is provided with a circular array of diffusion fuel discharge holes 114, each arranged at a compound angle.

With specific reference to FIG. 2, a flame holding swirler 116 which may or may not be integral with the nozzle is located at the forward end of the secondary nozzle, extending radially between the reduced diameter forward end 108 and the liner 52 for swirling the premixed fuel/air flowing within the liner.

From the above description, it will be appreciated that fuel from diffusion pipe $P_1$ will flow through a diffusion passageway established by passages 66 and 106 for discharge through fuel discharge holes 114 located at the forward end 110 of the sleeve 102.

Combustion air will enter the secondary nozzle assembly 56 via holes 70 and will flow through passages 68 and space 93 for discharge through swirler slots 96.

It will be further apparent that fuel from premix pipe $P_2$ will flow through a premix passage defined by passage 64, pilot bore 98 and pilot orifice 100. This fuel, along with air from swirler slots 96 provide a diffusion flame sub pilot. At the same time, a majority of the fuel supplied to the premix passage will flow into the gas injectors 80 for discharge from orifices 82 into the liner 52 where it is mixed with air.

The above described nozzle construction provides for improved transfer to the premixed mode of operation via a diffusion flame and, once in the premixed mode, operates to turn off the diffusion flame and start the premixing flame, enabling the gas turbine to operate at its design point over extended periods of time.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A secondary nozzle for a gas turbine which includes primary and secondary combustion zones, the secondary nozzle comprising: an elongated, tubular nozzle body having an inlet end and an outlet end; a tubular core assembly having an outer diameter less than an interior diameter of said tubular nozzle body to thereby define a first axial fuel passage between said core assembly and said tubular nozzle body extending to at least one discharge orifice at said outlet end, and a second axial fuel passage through said core assembly extending to a pilot orifice at said outlet end; an air passage located along at least a portion of said tubular nozzle body and located radially between said first and second fuel passages; and, a plurality of gas injectors extending radially out of said elongated tubular nozzle body from said second fuel passage, upstream of said outlet ends.

2. The secondary nozzle of claim 1 wherein said first and second fuel passages are supplied by first and second fuel supply sources, respectively.

3. The secondary nozzle of claim 1 and including a plurality of radial air inlets to said air passage located rearward of said gas injectors.

4. The secondary nozzle of claim 1 wherein said first fuel passage terminates at a plurality of discharge holes at said outlet end, radially outwardly of a center axis of said tubular nozzle body.

5. The secondary nozzle of claim 1 wherein said air passage terminates at a plurality of swirler discharge slots, radially outwardly of a center axis of said tubular nozzle body.

6. The secondary nozzle of claim 1 wherein said pilot orifice is located on a center axis of said tubular nozzle body.

7. In a gas turbine combustor provided with a plurality of primary fuel nozzles arranged in an annular array, and a secondary nozzle located within a centerbody of the combustor, said secondary nozzle extending to a combustor throat portion located axially between primary and secondary combustion zones, the improvement wherein said secondary nozzle comprises an elongated, tubular nozzle body having an inlet end and an outlet end; a tubular core assembly having an outer diameter less than an interior diameter of said tubular nozzle body to thereby define a diffusion fuel passage between said core assembly and said tubular nozzle body extending to at least one discharge orifice at said outlet end, and a premix fuel passage through said core assembly extending to a pilot orifice at said outlet end; an air passage located along at least a portion of said tubular nozzle body and located radially between said diffusion and premix fuel passages; and, a plurality of gas injectors extending radially out of said elongated tubular nozzle body from said premix fuel passage, upstream of said outlet end.

8. The secondary nozzle of claim 7 wherein said fuel diffusion and premix passages are supplied by first and second fuel supply sources, respectively.

9. The secondary nozzle of claim 7 and including a plurality of radial air inlets to said air passage located rearward of said gas injectors.

10. The secondary nozzle of claim 7 wherein said diffusion fuel passage terminates at a plurality of discharge holes at said outlet end, radially outwardly of a center axis of said tubular nozzle body.

11. The secondary nozzle of claim 10 wherein said air passage terminates at a plurality of swirler discharge slots, radially inwardly of said plurality of diffusion fuel discharge holes and radially outwardly of said center axis.

12. The secondary nozzle of claim 11 wherein said premix fuel passage terminates at a discharge orifice located on said center axis.

13. The secondary nozzle of claim 7 wherein said air passage comprises a first portion including a plurality of annularly arranged passages, and a second portion including a single annular space surrounding said pilot portion.

* * * * *